US006591941B1

(12) United States Patent
Mannie

(10) Patent No.: US 6,591,941 B1
(45) Date of Patent: Jul. 15, 2003

(54) LADDER SACK

(76) Inventor: Roger Mannie, 5015 Boulder La., Santa Rosa, CA (US) 95405

( * ) Notice: Subject to any disclaimer, the term of this patent is extended or adjusted under 35 U.S.C. 154(b) by 0 days.

(21) Appl. No.: 10/057,499

(22) Filed: Jan. 22, 2002

Related U.S. Application Data

(63) Continuation-in-part of application No. 09/528,897, filed on Mar. 20, 2000, now abandoned.
(60) Provisional application No. 60/130,789, filed on Apr. 23, 1999.

(51) Int. Cl.[7] ..... E04G 1/00
(52) U.S. Cl. ..... 182/129; 248/210; 206/373
(58) Field of Search ..... 182/26, 121, 122, 182/129; 248/210, 238; 206/373; 160/370.21

(56) References Cited

U.S. PATENT DOCUMENTS 4,148,347 A * 4/1979 Seaman ..... 150/1.7
4,182,391 A * 1/1980 Kjose ..... 150/1.5
4,210,244 A * 7/1980 Westrick ..... 206/373
4,317,478 A * 3/1982 Babbidge ..... 150/10
4,402,440 A * 9/1983 Purtzer et al. ..... 224/160
4,500,592 A * 2/1985 Lee et al. ..... 428/251
4,511,358 A * 4/1985 Johnson, Jr. et al. ..... 604/327
4,773,535 A * 9/1988 Cook ..... 206/373
5,003,634 A * 4/1991 Brinkman ..... 2/46
5,035,460 A * 7/1991 Huang ..... 296/95.1
5,401,074 A * 3/1995 Timerman ..... 296/136
5,466,179 A * 11/1995 Jeffrey, Sr. ..... 441/108
5,647,453 A * 7/1997 Cassells ..... 182/129
5,890,640 A * 4/1999 Thompson ..... 224/630
5,971,101 A * 10/1999 Taggart ..... 182/129
5,988,383 A * 11/1999 Armstrong ..... 206/373
6,116,419 A * 9/2000 Campagna et al. ..... 206/373
6,435,304 B1 * 8/2002 Stierle ..... 182/129
6,450,337 B1 * 9/2002 Campagna et al. ..... 206/373

* cited by examiner

*Primary Examiner*—Bruce A. Lev
(74) *Attorney, Agent, or Firm*—Larry D. Johnson; Craig M. Stainbrook; Johnson & Stainbrook, LLP

(57) ABSTRACT

A ladder sack adapted for placement between the legs of a folding step ladder to provide an open platform on which to place tools or working materials while working atop the ladder, and a closed secured pouch to carry tools and working materials when the ladder is closed. The sack is formed from a rectangular section of fabric having hook and loop fasteners positioned along the sides of the sack that may be approximated to form a secured enclosure when the sack is folded end to end when the ladder is closed. When the ladder is reopened to its standing position the sack unfolds to provide easy access to the tools and working materials contained therein. The ladder sack includes straps and buckles at its ends for attachment to ladder rungs of varying sizes.

11 Claims, 2 Drawing Sheets

LADDER SACK

CROSS REFERENCE TO RELATED APPLICATIONS

The present invention is a continuation-in-part of U.S. pat. appl. Ser. No. 09/528,897, filed on Mar. 20, 2000 now abandoned, which claims the benefit of the filing date of U.S. Provisional Patent Application, Ser. No. 60/130789, filed Apr. 23, 1999.

STATEMENT REGARDING FEDERALLY SPONSORED RESEARCH OR DEVELOPMENT

Not applicable.

REFERENCE TO A MICROFICHE APPENDIX

Not applicable.

TECHNICAL FIELD

The present invention relates generally to ladder accessories, and more particularly to a ladder sack placed between the legs of a folding step ladder and adapted for holding tools and working materials while working atop the ladder.

BACKGROUND INFORMATION AND DISCUSSION OF RELATED ART

It is well known that carrying tools and work materials up and down a ladder is a waste of time and energy. Moreover, the advantages of providing easy access to tools and materials to one working atop a ladder is well known. Accordingly, a number of ladder accessories have been developed to function as trays and caddies for holding tools and materials while working atop a ladder. Representative of such accessories are the following:

U.S. Pat. No. 6,012,689 to Sisca, discloses a combination accessory container and safety device designed to be mounted over the top of an A-frame ladder comprising a domed top and at least one side container. The domed top sits on the top platform of a ladder and can be mounted to the top platform.

U.S. Pat. No. 5,647,453 to Cassells teaches a multi-purpose ladder utility apron having four side panels, each including a tool and accessory receptacles, and further having a fold-up storage tray on the ladder's top.

U.S. Pat. No. 5,603,405 to Smith describes a ladder top storage rack that includes a rigid tool box securable to a ladder top, a pair of side pouches secured to two side walls of the tool box, and a rear pouch secured to the rear wall of the tool box.

U.S. Pat. No. 5,542,553 to Pennimann discloses a ladder caddy comprising a housing having a vertical side wall, a container on the side wall for holding tools and a handle coupled to and extending upwardly from the side wall, and a coupling mechanism for removably coupling the side wall to the legs of a ladder.

U.S. Pat. No. 4,356,854 to McGee teaches a work pouch has a central compartment configured to fit the top of a stepladder and a skirt which hangs over the top portion of the ladder with a number of side compartments.

U.S. Pat. No. 5,971,101 to Taggart describes a carrier device suitable for use on a variety of platforms, including ladders. The carrier is fabricated from foldable material and is draped over the top step of a step ladder. When so draped, a plurality of pockets and storage compartments are available to hold tools, workpieces, extension cord ends, and the like.

U.S. Pat. No. 4,773,535 to Cook discloses a portable tool case taking several different embodiments, including a tool case adapted for installation on a ladder. The case includes a top horizontal panel and four vertical panels which define an open-bottom boxlike device that may be positioned over the top of a ladder. Pockets for tools are located on the exterior surfaces of the vertical panels.

While many of the above-indicated devices function well in providing means for containing and holding tools and materials on a ladder, none of the references disclose a flexible panel which may be positioned between the two legs of a ladder and which deploys from a folded and closed configuration to a flat and entirely open configuration by spreading the legs of a ladder.

SUMMARY OF THE INVENTION

The ladder accessory of the present invention is in the nature of a ladder sack and comprises a generally rectangular section of fabric adapted for removable placement between the legs of a folding step ladder to provide a surface to place tools or working materials used while working atop the ladder. The device is made of a fabric that is flexible and easily folds to surround and hold the materials when the ladder is placed in its folded or closed position. The capacity of the sack to hold, the tools and materials when closed is enhanced by the inclusion of fastening means, preferably hook and loop fasteners, positioned along the sides of the sack; when the ladder is closed the sides may be approximated to form a secured enclosure in the form of a pouch. Accordingly, without having to remove the tools from their position on the ladder, the user may collapse the ladder and move the ladder along with the tools from one work space to another. When the ladder is reopened and the legs spread into a standing position, the sack unfolds into a substantially flat platform to provide easy access to the tools and working materials contained therein.

The ladder sack includes straps and buckles at its ends for attachment to ladder rungs of varying sizes. Additionally, each end of the sack includes a stiffened rod to provide structural support during transport and use.

Unlike may prior art devices adapted for installation on a ladder for holding tools, the present invention does not include a plurality of pockets into which specific tools or articles are to be held or stored. Rather, the present invention is intended to have more universal applicability, so that tools and workpieces of varying sizes (including large tools) can be contained within the closed pouch or set upon the deployed platform.

DETAILED DESCRIPTION OF A PREFERRED EMBODIMENT

Figure 1:
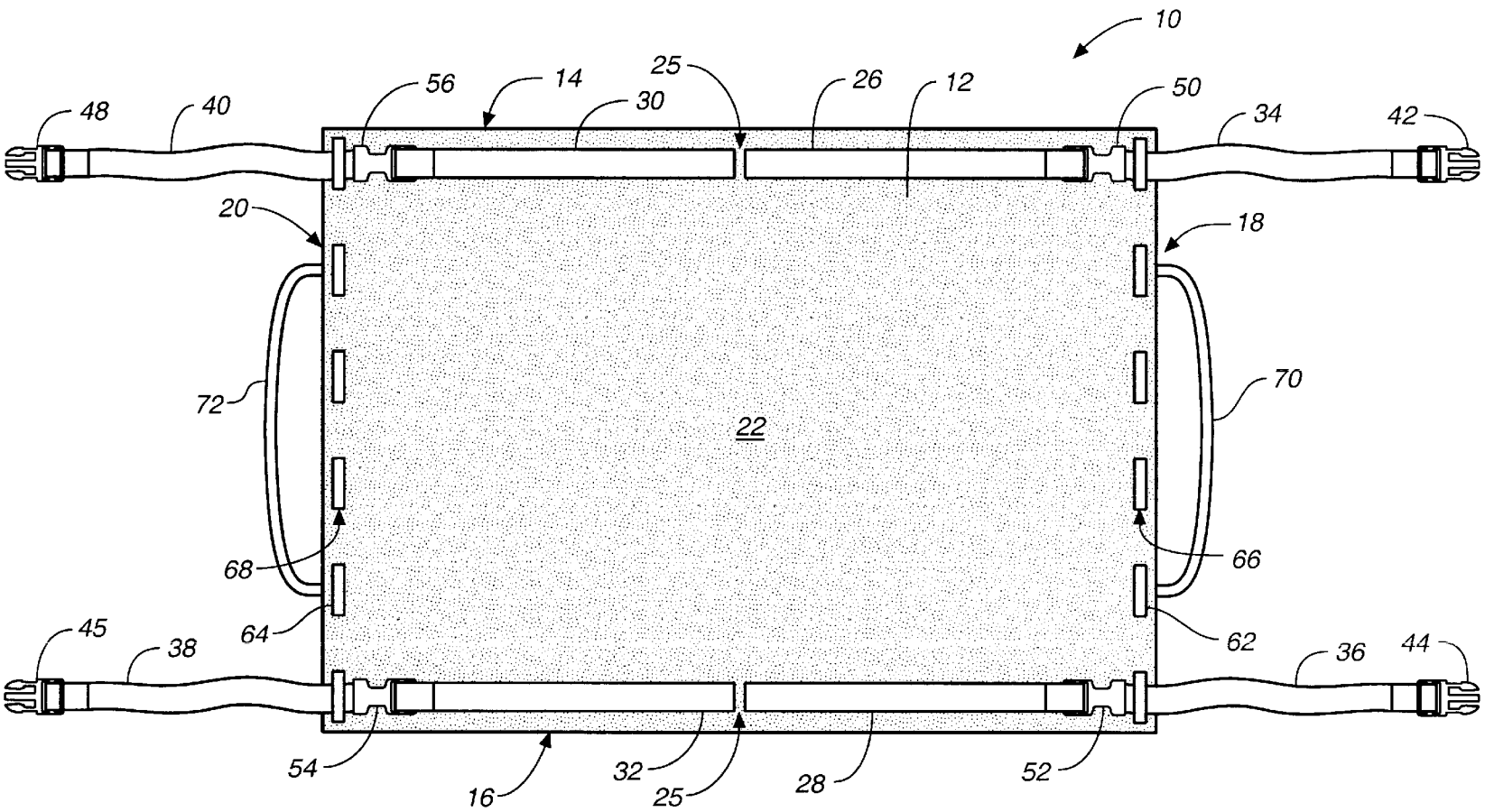
FIG. 1 is top view of the ladder accessory of the present invention.
Figure 3:
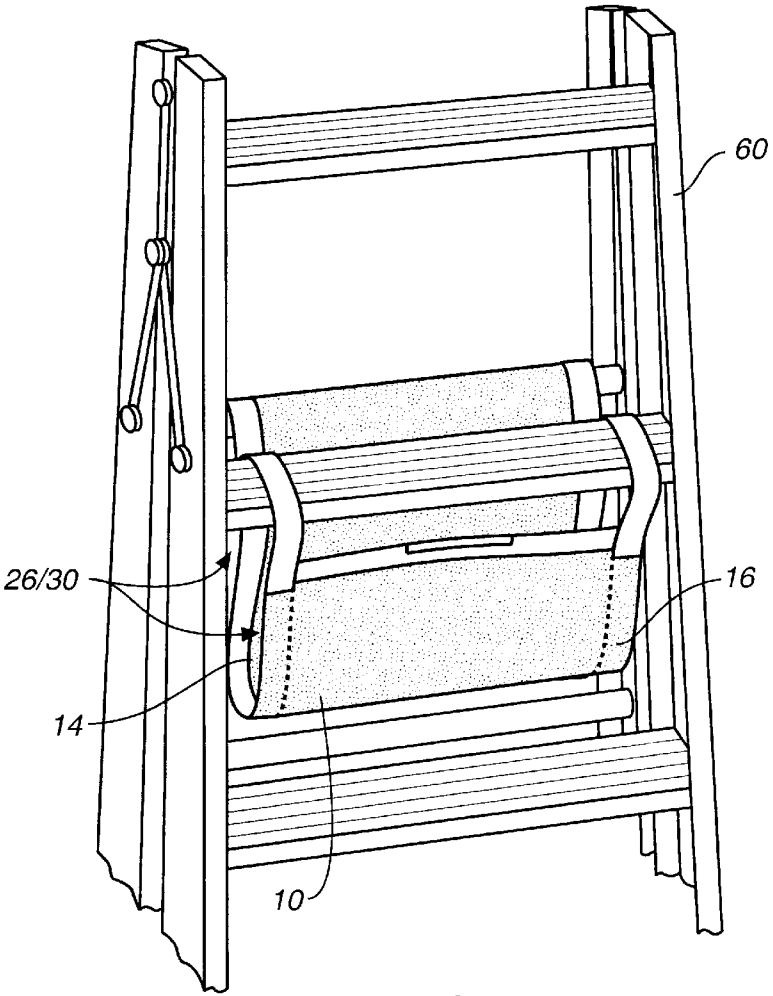
FIG. 3 is a perspective view showing the installed ladder accessory of FIG. 2 when the ladder is folded into its closed position.
Figure 2:
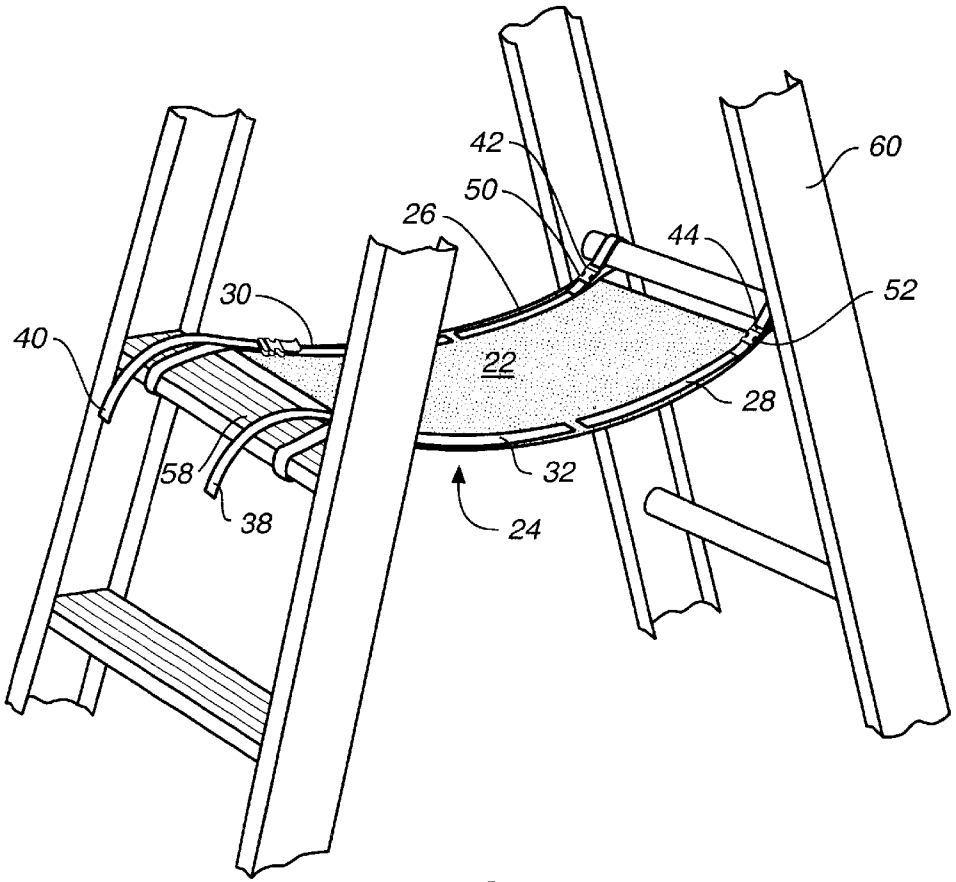
FIG. 2 is a perspective view showing the ladder accessory in the environment of its application as positioned between the legs of a step ladder in its open, standing position.

Referring now to FIGS. 1–3, wherein like reference numerals refer to like components in the various views, FIG. 1 is a top view of the ladder sack of the present invention, generally denominated 10. This view shows that the ladder sack comprises a substantially rectangular section of flexible fabric 12, preferably made of a nylon or polyester with a urethane coating, and more preferably urethane coated polyester staple fiber 6D by 51 mm, such as 600 DENIER™ polyester. The fabric section has first and second sides, 14 and 16, first and second ends, 18 and 20, an upper surface 22, and a lower surface 24. Sewn onto the upper surface 22 of each of the sides and extending from approximately the middle, or fold line 25, of the sack to a point proximate the first end are strips of hook material 26 and 28, having complementary loop material 30, 32, extending from the fold line to a point proximate the second end 20. Thus configured, the upper surface 22 of the fabric may be folded upon itself end to end at the fold line and the hook and loop fastening material pressed together and secured to form a substantially closed sack having an opening where the ends are approximated.

Extending longitudinally beyond the ends of the sack are elongate strips of flexible material, such as nylon cord or fabric webbing 34, 36, 38, 40, preferably nylon or aramid fiber (i.e., KEVLAR®) or other suitably sturdy natural or synthetic material. Each of the strips terminate in a male buckle 42, 44, 46, 48, which are adapted for coupling with female buckle members 50, 52, 54, 56, respectively. The female buckle members are affixed to either the sack or to the webbing at each of the corners of the sack. The strips of webbing and buckle members enable the sack to be installed at or near the top rung 58 of a conventional, foldable step ladder 60, and further allow for adjusting and tightening the sack to provide a taut and generally flat platform when the ladder is.;opened into its standing position, as shown in FIG. 2.

To provide the sack with increased stability, reinforcement rods 62, 64 of fiberglass or cold rolled steel are inserted into integral openings 66, 68 running transversely along each end 18, 20 of the sack. For convenience, fabric handles 70, 72 are also affixed at each of the two ends of the sack so that when the sack is removed from the ladder, it may be easily carried as an enclosed pouch with the tools.

FIG. 3 shows the ladder sack 10 as installed on a ladder, 60, in its closed or folded position. It is shown with its first side 14 in an open position with hook and loop material 26/30 exposed, while the second side 16 is pressed closed. As may be readily appreciated, both sides may be pressed shut to form an enclosed container for tools and work materials. Accordingly, in an economy of energy and effort, the user may close the ladder without removing the tools and materials being used on the job, and may then carry the ladder with the installed sack to another work space.

In another aspect, the present invention may be characterized as a combination support platform and tool sack for holding tools and work pieces between the legs of a step ladder, comprising a flexible fabric panel having two sides, first and second ends, an upper surface, a lower surface, and a flexible mid-section such that said panel may be folded and said ends approximated; coupling means attached to each of said ends of said fabric for suspending said platform between the legs of the step ladder; pouch forming means, wherein when the legs of the step ladder are folded into a closed position said ends of said fabric panel are approximated and said pouch forming means may be employed to close said sides of said fabric to form a pouch having an upper opening defined by said ends of said fabric panel. As described above, the coupling means preferably trips of fabric and buckles disposed thereon; and the pouch forming means comprise hook and loop material opposingly affixed to the upper surface of the fabric panel.

While this invention has been described in connection with preferred embodiments thereof, it is obvious that modifications and changes therein may be made by those skilled in the art to which it pertains without departing from the spirit and scope of the invention. For instance, it would be obvious to fabricate the sack and the flexible material straps from any of a number of suitable materials. It would also be obvious to position the buckle assemblies on the side opposite the hook and loop fastener material so that the webbing and male buckle members could first be pulled over a ladder rung before being looped back and under for coupling to the female buckle members. Accordingly, the scope of this invention is to be limited only by the appended claims.

What is claimed as invention is:

1. A combination ladder sack and support platform removably installable on a folding step ladder, wherein the step ladder has an open configuration in which its legs are spread and a closed configuration in which its legs are substantially approximated apparatus comprising:

a substantially rectangular fabric panel having a fold line, first and second sides, first and second ends, an upper surface, and a lower surface, said fabric panel having sufficient flexibility such that said panel may be folded and said first and second ends approximated;

first fastening means affixed to said upper surface of each of said sides and extending from approximately said fold line to proximate said first end;

second fastening means affixed to said upper surface of each of said sides and extending from approximately said fold line to proximate said second end; and first and second coupling means connected to said first and second ends, respectively, which enable said apparatus to be removably installed between the legs of a step ladder;

wherein when said apparatus is installed on a step ladder, and when the legs of the step ladder are approximated to form the closed configuration, said first and second ends of said fabric panel are approximated and first and second fastening means means may be employed to close said sides of said fabric to form a closed sack having an opening formed between said first and second ends of said fabric panel, and wherein when said legs of the step ladder are spread to form the standing configuration, said first and second ends of said fabric panel move in cooperation with the legs of the ladder to spread apart so that said fabric panel forms a substantially flat platform for holding tools on said upper surface.

2. The apparatus of claim 1, wherein said first fastening means is hook material and said second fastening means is loop material complementary to said hook material.

3. The apparatus of claim 1 wherein said coupling means comprises buckle members affixed to strips of fabric sewn into each of said first and second ends of said fabric panel.

4. The apparatus of claim 3, wherein said buckle members are adjustable and may be employed to adjust the tension in said strips of fabric such that said fabric panel is taut when the legs of the ladder are extended into a fully open and standing position.

5. The apparatus of claim 1 further including stiffening means to prevent said ends of said apparatus from folding while in use.

6. The apparatus of claim 5 wherein said stiffening means comprises a first and second fiberglass rods inserted into an integral opening running transversely along each end of said apparatus.

7. The apparatus of claim 5 wherein said stiffening means comprises a first and second cold rolled steel rods inserted into an integral opening running transversely along each of said first and second end of said apparatus.

8. The apparatus of claim 1 further including first and second carrying handles, one each affixed at one of said first and second ends of said apparatus so that when said apparatus is removed from the ladder, said apparatus comprises a pouch closed on its sides and open at its ends that may hold workpieces and tools and can be carried by said first and second handle.

9. The apparatus of claim 8, wherein said carrying handles comprise strips of fabric sewn into said ends of said apparatus.

10. The apparatus of claim 1 wherein said apparatus is made from nylon fabric.

11. The apparatus of claim 1 wherein said apparatus is made from urethane coated polyester staple fiber.

* * * * *